US010054136B2

(12) United States Patent
Sowa et al.

(10) Patent No.: US 10,054,136 B2
(45) Date of Patent: Aug. 21, 2018

(54) PUMP WITH CUTTING WHEEL AND PRE-CUTTER

(71) Applicant: Brinkmann Pumpen K.H. Brinkmann GmbH & Co. KG, Werdohl (DE)

(72) Inventors: Guido Sowa, Iserlohn (DE); Dirk Wenderott, Castrop-Rauxel (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 250 days.

(21) Appl. No.: 14/915,596

(22) PCT Filed: Aug. 18, 2014

(86) PCT No.: PCT/EP2014/067575
§ 371 (c)(1),
(2) Date: Feb. 29, 2016

(87) PCT Pub. No.: WO2015/032610
PCT Pub. Date: Mar. 12, 2015

(65) Prior Publication Data

US 2016/0215794 A1 Jul. 28, 2016

(30) Foreign Application Priority Data

Sep. 4, 2013 (DE) ..... 20 2013 103 975 U

(51) Int. Cl.

| | |
|---|---|
| ***F04D 29/70*** | (2006.01) |
| ***B02C 18/00*** | (2006.01) |
| ***F04D 7/04*** | (2006.01) |
| ***F04D 1/00*** | (2006.01) |
| *F04D 29/64* | (2006.01) |

(52) U.S. Cl.
CPC ..... *F04D 29/708* (2013.01); *B02C 18/0092* (2013.01); *F04D 1/003* (2013.01); *F04D 7/045* (2013.01); *F04D 29/642* (2013.01)

(58) Field of Classification Search
CPC ..... F04D 29/708; F04D 1/003; F04D 7/045; F04D 29/70
See application file for complete search history.

(56) References Cited

U.S. PATENT DOCUMENTS

| | | | |
|---|---|---|---|
| 3,417,929 | A | 12/1968 | Secrest |
| 5,460,483 | A | 10/1995 | Dorsch |

(Continued)

FOREIGN PATENT DOCUMENTS

| | | | |
|---|---|---|---|
| DE | 102008031842 | B3 | 3/2010 |
| DE | 102009021659 | A1 | 1/2011 |

(Continued)

*Primary Examiner* — Woody Lee, Jr.
*Assistant Examiner* — Maxime Adjagbe
(74) *Attorney, Agent, or Firm* — Richard M. Goldberg

(57) ABSTRACT

A pump having a cutting wheel and a pre-cutter (26) for cutting chippings that are contained in the medium pumped by the pump, the pre-cutter being driven by a shaft portion that projects axially from the cutting wheel and having a plurality of wings (28), the pre-cutter being surrounded by a crest of anvil blocks (32) at which the free ends of the wings (28) move past in a little distance when the pre-cutter rotates, wherein the anvil blocks are configured as counter-blades (32) that are held exchangeably at a blade carrier (34) that surrounds the pre-cutter (26) at least on a part of its periphery.

10 Claims, 3 Drawing Sheets

(56) References Cited

U.S. PATENT DOCUMENTS

| | | | | |
|---|---|---|---|---|
| 7,159,806 | B1 * | 1/2007 | Ritsema | B02C 18/0092 241/258 |
| 7,841,550 | B1 | 11/2010 | Dorsch et al. | |
| 8,267,643 | B2 | 9/2012 | Wagner et al. | |
| 2009/0067992 | A1 | 3/2009 | Keener | |
| 2011/0220746 | A1 | 9/2011 | Dorsch | |
| 2013/0121811 | A1 | 5/2013 | Cuppetelli | |

FOREIGN PATENT DOCUMENTS

| | | | |
|---|---|---|---|
| GB | 567472 | A | 2/1945 |
| GB | 1425821 | A | 2/1976 |
| JP | 2012233457 | A | 11/2012 |
| UA | 79858 | C2 | 7/2007 |

* cited by examiner

PUMP WITH CUTTING WHEEL AND PRE-CUTTER

BACKGROUND OF THE INVENTION

The invention relates to a pump having a cutting wheel and a pre-cutter for cutting chippings that are contained in the medium pumped by the pump, the pre-cutter being driven by a shaft portion that projects axially from the cutting wheel and having a plurality of wings, the pre-cutter being surrounded by a crest of anvil blocks at which the free ends of the wings move past in a little distance when the pre-cutter rotates.

A pump of this type is known from DE 10 2008 031 842 B3 and is used for example in machine tools for circulating lubricating coolant emulsions that are contaminated with metal chippings. This pump is a centrifugal pump that has, in addition to a radial impeller, an axial impeller disposed upstream of the radial impeller, said axial impeller being configured as a cutting impeller and having, at its upstream end, cutting edges that cooperate with stationary counter blades arranged radially in a suction passage, so that chippings and other contaminants that have been sucked in are cut-off and chopped. The pre-cutter serves for chopping coarse contaminants before they are sucked-in by the axial impeller and are then chopped further. In this pump, the anvil blocks are formed by the intake port of the pump having, at the level of the pre-cutter, a non-circular, approximately polygonal cross-section.

SUMMARY OF THE INVENTION

It is an object of the invention to provide a pump with improved the chopping efficiency.

According to the invention, this object is achieved by the feature that the anvil blocks are configured as counter-blades that are held exchangeably at a blade carrier that surrounds the pre-cutter at least on a part of its periphery.

The counter-blades serve to crush or chop the chippings, in particular longer chippings, when they are entrained by the wing of the pre-cutter in rotary direction and are thereby forced outwardly. Since the counter-blades are therefore subject to increased wear, they are exchangeable according to the invention.

Useful embodiments and further developments of the invention are indicated in the dependent claims.

In a useful embodiment, each counter-blade forms a straight rupture edge that is directed radially towards the pre-cutter and extend straight in parallel to the axis of rotation of the pre-cutter. The counter-blades can preferably be exchanged individually. They can be configured as reversible plates which may be mounted in reversed orientation when the rupture edge is worn out, so that a new rupture edge will then be facing the pre-cutter. Optionally, the counter-blades may be adjustable in their axial and/or radial position.

In a preferred embodiment, each wing of the pre-cutter has, on the side that is leading in the direction of rotation, a convexly curved edge, and at its free end an outwardly angled catch that obstructs the movement of chippings that slide along the convexly curved edge of the wing and prevents them from slipping off the wing prematurely.

According to the invention, as another measure to increase the life time of the pump, each wing of the pre-cutter has at its leading edge a wear resistant coating, e.g. in the form of a wear-reducing welded layer. This measure may be employed successfully also independently of the other features of the invention as described above.

BRIEF DESCRIPTION OF THE DRAWINGS

An embodiment example will now be described in conjunction with the drawings, wherein.

DETAILED DESCRIPTION

Figure 1:
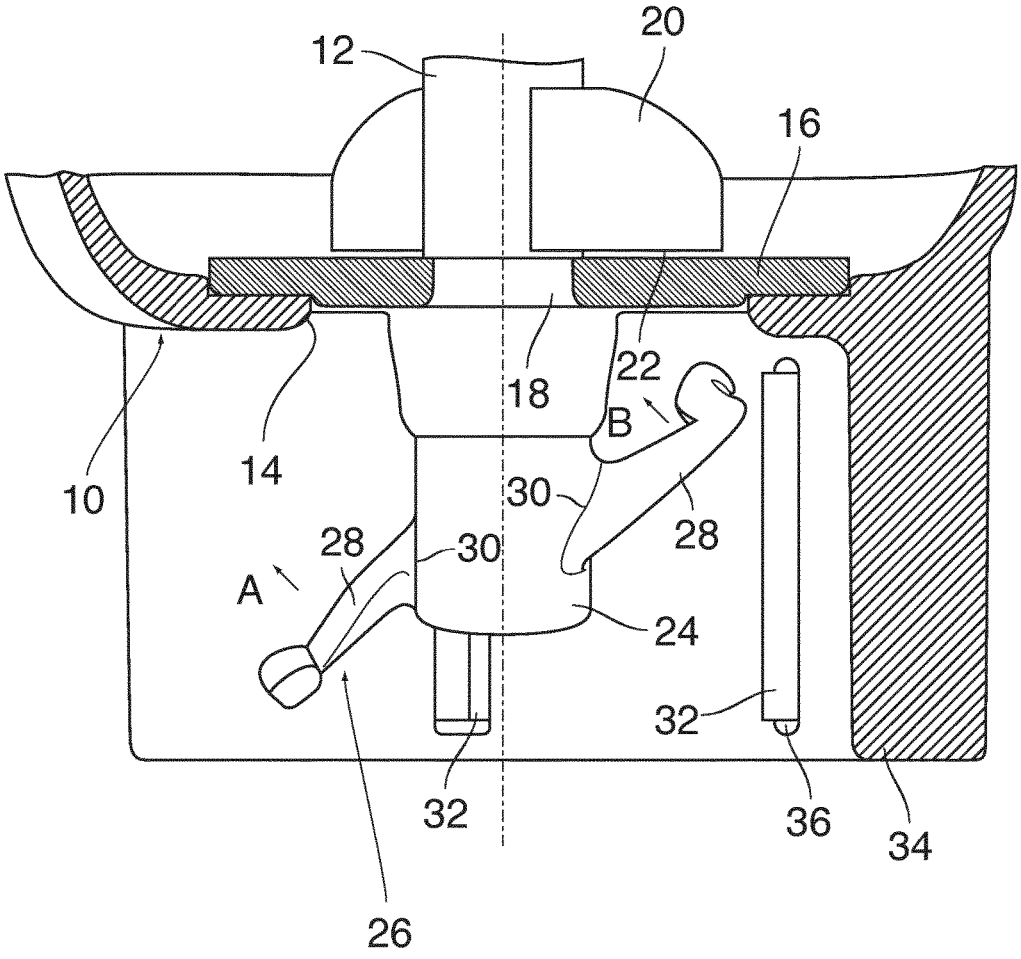
FIG. 1 is an axial cross-sectional view of an intake part of a pump according to the invention.

The pump, a part of which has been shown in an axial section in FIG. 1, comprises a casing 10 which rotatably supports a shaft 12 and forms a suction opening 14 that is arranged coaxially with the shaft. In another part, which has not been shown and is situated more upwardly, the casing 10 forms a pump chamber accommodating a rotating impeller, e.g. a radial impeller that is keyed onto the shaft 12.

It shall be assumed in the following that the pump has been installed in a vertical orientation in a collecting vessel (not shown) for a lubricating coolant, so that its suction opening 14 faces the bottom of the vessel and is immersed into the liquid contained in this vessel. Thus, the liquid will be sucked-in by the pump upwardly through the suction opening 14.

Inserted in the suction opening 14, there is cutting plate 16 which blocks a larger part of the suction opening and leaves only four smaller passages 18. In the sectional view in FIG. 1, the section plane, indicated by a line I-I in FIG. 2, extends offset from the centre of the suction opening, so that one of the passages 18 is cut through.

Figure 2:
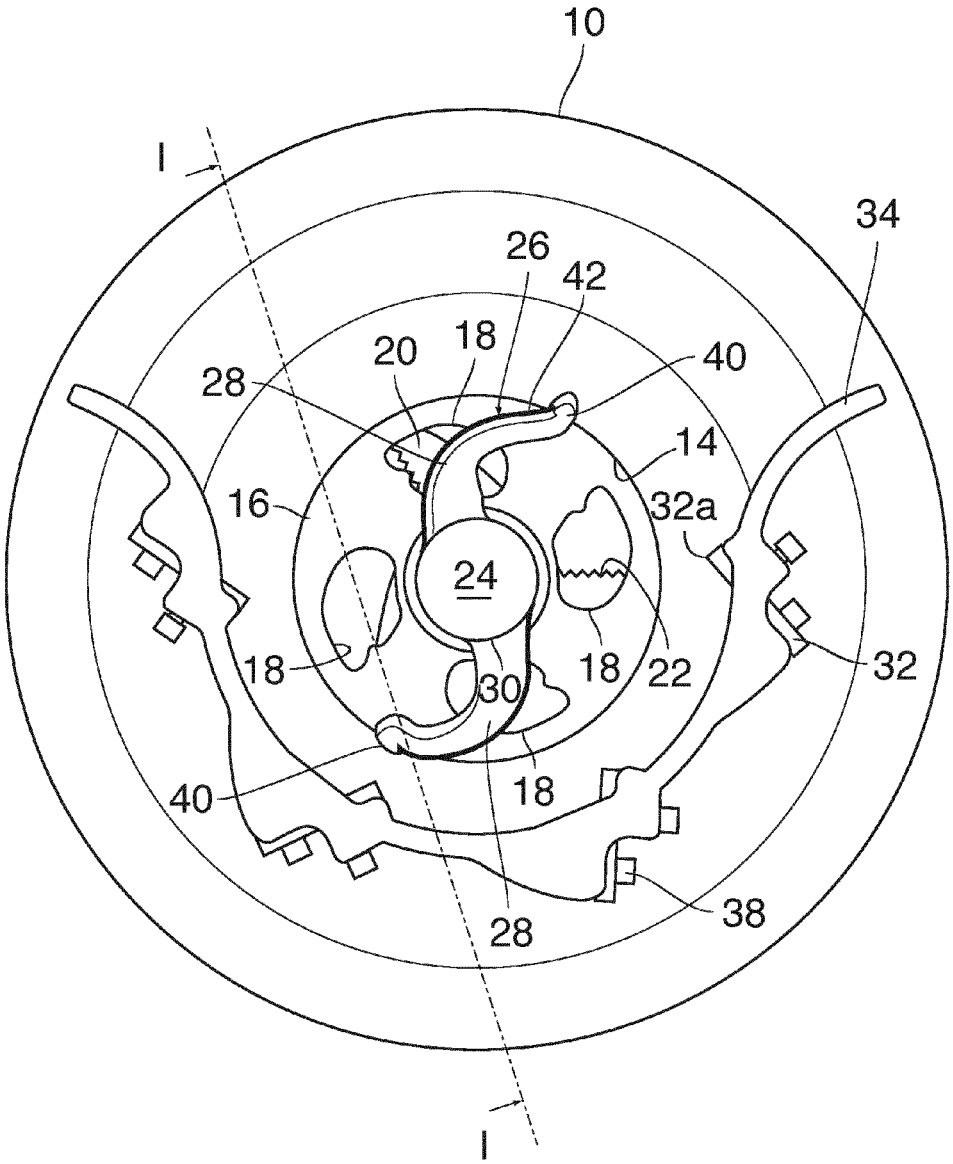
FIG. 2 is a perspective view of the intake part from below.

A cutting wheel 20 is mounted on the shaft 12 above the cutting plate 16, and blades of this cutting wheel are formed at their lower end with cutting edges 22 which, when the cutting wheel 20 rotates, move closely above and across the top ends of the passages 18. In FIG. 2, the toothed cutting edges 22 of the cutting wheel can be seen through the passages 18. The blades of the cutting wheel 20 (three blades arranged with angular spacings of 120° in example shown in FIG. 2) may be curved in the direction of rotation, so that the cutting wheel 20 acts as a radial impeller. Optionally, however, they might also have a helical shape so that the cutting wheel would act as an axial impeller.

When, as is frequently the case for machine tools, the lubricating coolant that is pumped back from the tool of the machine into the collection vessel contains chippings of the work piece that has been processed, e.g. steel chippings, these will be sucked-in through the suction opening 14 together with the liquid, and when they pass through the passages 18 they will be caught by the cutting edges 22 of the cutting wheel and will be cut at the edge of the passages 18. In this way, the chippings can be prevented from becoming entangled and clogging or blocking the pump. In addition, the chippings will be cut to a size in which they can more easily be entrained in the flow of the coolant. This reduces the risk of clogging downstream pipings.

The shaft 12 of the pump passes through a central bore of the cutting plate 16 and forms, below this cutting plate, a shaft portion 24 that carries a pre-cutter 26 for precutting the chippings. As shown in FIG. 2, the pre-cutter 26 has two wings 28 which, when seen in a projection onto the plane orthogonal to the axis of the shaft 12 (the plane of the drawing in FIG. 2), are so arranged and shaped that they are symmetric under a 180° rotation about the axis of the shaft 12. The wings 28 have a curved shape and extend from base portions 30, with which they are attached to the shaft portion 24, at first radially outwardly, but are then curved into the circumferential direction, so that their free ends are trailing in the direction of rotation (counter-clockwise in FIG. 2).

While the wings 28 are symmetric in the projection shown in FIG. 2, it can be seen in FIG. 1 that they differ from one another in their axial arrangement on the shaft portion 24. In particular, the base portions 30 of the two wings are axially offset relative to one another. In case of the left wing in FIG. 1, the base portion 30 is closer to the distal end of the shaft portion 24, i.e. in a lower position, whereas in case of the right wing in FIG. 1, it is disposed in a higher position, closer to the cutting plate 16.

Moreover, the left wing 28 in FIG. 1 slants downwardly towards its free end, so that it forms an obtuse angle of approximately 135° with the axis of the shaft 12, whereas the other wing slants upwardly and, consequently, forms an acute angle of approximately 45° with the axis of the shaft 12.

Furthermore, the wings 28, in particular their intermediate portions extending between the base portion 30 and the free end, are angled like propeller wings, so that the wings, together, create an upwardly directed suction that will cause the liquid medium to be displaced towards the suction opening 14.

As the left wing 28 in FIG. 1 is closer to the bottom of the vessel, it is particularly suited for lifting relatively heavy chippings that rest on the bottom of the vessel and to convey them towards the suction opening 14. Due to the slanting posture of this wing, it imparts to the liquid medium and to the chippings a momentum that has approximately the direction indicated by an arrow A in FIG. 1 and, consequently, has a component directed radially outwardly. However, before the chippings can move in radial direction too far away from the shaft portion 24, they enter into a region where they are affected by the other wing 28 (the right wing in FIG. 1) which imparts them a momentum in the direction of the arrow B and, consequently, drives them back in the direction towards the axis of the shaft portion 24 and hence in the direction of the passages 18 of the cutting plate 16. In this way, the two wings 28 operate, so to say, in work-sharing fashion, with one wing having the task to lift heavy chippings from the bottom of the vessel and the other wing having the task of conveying these chippings further towards the suction opening 14 where the chippings will then be cut by means of the cutting wheel 20 in the passages 18.

However, thanks to the curved shape of the wings 28 and thanks to the slanting postures of these wings, the chippings are not moved directly from the bottom of the vessel to the passages 18, but instead they are at first driven radially outwardly at the curved leading edges of the wings 28, so that they enter into the range of action of stationary counter blades 32 that are held in a blade carrier 34 and extend in parallel with the axis of the shaft 12 and the shaft portion 24.

In the example shown, the counter-blades 32 are formed by rectangular plates made of a hard material (e.g. duplex cast steel, hard metal, hardened tool steel) each of which forms a rupture edge directed towards the pre-cutter 26. As the outer peripheral portions of the wings 28 move past the counter blades 32 in only a little distance, the chippings entrained therewith, especially long chippings that tend to become entangled, are fragmented at the counter blades 32 so that they may smoothly be moved on towards the passages 18.

In the example shown, the blade carrier 34 is shaped as a vertical wall with a U-shaped cross-section which flares outwardly in funnel-shape at the open side of the U (upwards in FIG. 2). When the pump is installed, for example, in a corner of a collecting vessel, the open side of the blade carrier may face the centre of the vessel, so that the coolant may enter laterally into the suction area of the pump. In this way, even when the distance to the bottom of the vessel is small, larger bunches of chippings may still enter into the reach of the pre-cutter. The counter-blades 32 are distributed at even angular spacings on an approximately semi-circular arc of the blade carrier and extend through openings 36 (FIG. 1) of the blade carrier 34 and are mounted detachably by means of bolts 38 (FIG. 2), so that they may be replaced when the rupture edges are worn-out.

Further, it can be seen especially in FIG. 2 that each wing 28 has a hook-shaped, outwardly angled catch 40 at its free end. In this example, the catch 40 is shaped as a step that forms an abutment surface 42 extending approximately orthogonally to the edge of the wing 28 and forming the start of an embossment 44 at the free end of the wing. When the chippings impinge onto the convexly curved front edge of the wing 28 and slide radially outwards along the wing, the catch 40 obstructs this slide movement to some extent, so that the chippings are somewhat held back in their position at the outer end of the wing, until this end of the wing moves past the rupture edge of one of the counter blades 32 and the chippings that are "suspended" at the catch are fragmented. In this way, a particularly efficient pre-chopping of the chippings can be achieved.

Figure 3:
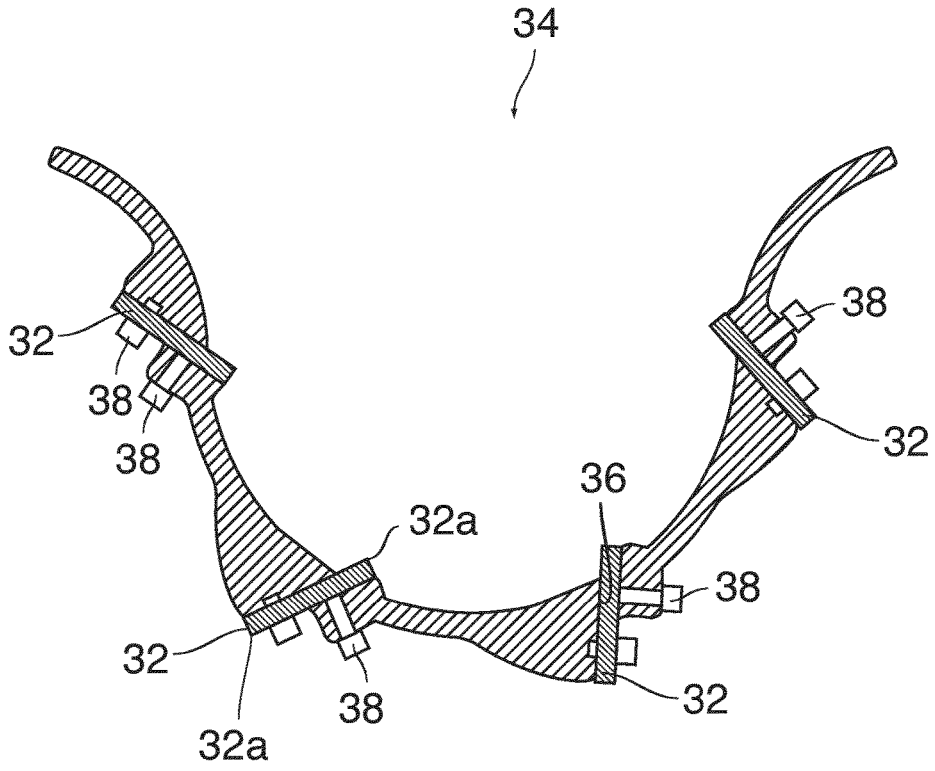
FIG. 3 a horizontal cross-section of a blade carrier with counter-blades mounted thereon.

In FIG. 3, the blade carrier 34 with the counter-blades 32 mounted thereon has been shown in cross-section. The openings 36 for the counter-blades are configured as slots that are delimited on both sides by embossments of the wall of the blade carrier 34, so that engagement surfaces for stably supporting each counter-blade are formed. The counter-blade may be fixed and clamped at these engagement surfaces by means of the bolts 38.

The counter-blades 32 are configured as reversible plates, with rupture edges 32*a* at two opposite edges or else at all four edges, so that a new rupture edge may be brought into an active position by reversing the counter-blade when the old rupture edge is worn-out. Moreover, the counter-blades 32 may optionally have some play in axial direction in the openings 36, so that their height relative to the catches of the wings 28 may be adjusted. This permits to vary the part of the rupture edge 32*a* that is subject to the largest wear.

When the holes of the counter-blades 32 that are penetrated by the bolts 38 are configured as elongated holes, it is also possible to vary the radial position of the counter-blades, so that the radial play between the catches 40 of the wings and the rupture edges 32*a* may be adjusted optimally. These elongated holes may be positioned such that a direct collision of the rupture edges 32*a* with the wings 28 is avoided in any case.

As the convexly curved edges of the wings 28 that form the leading edges in the direction of rotation are also subject to an increased wear, these edges are preferably covered by a wear-resistant welded layer 42 that has been shown symbolically in FIG. 2 as a bold line.

What is claimed is:

1. A pump comprising:

a cutting wheel for cutting chippings that are contained in a medium pumped by the pump, a pre-cutter for cutting chippings that are contained in the medium pumped by the pump, the pre-cutter including a plurality of wings, a shaft portion which drives the pre-cutter and the shaft portion projects axially from the cutting wheel, and a crest of anvil blocks surrounding the pre-cutter such that free ends of the wings move past the anvil block with a little distance therebetween when the pre-cutter rotates, and the anvil blocks are configured as counter-blades that are held exchangeably at a blade carrier that surrounds the pre-cutter at least on a part of a periphery thereof, wherein the blade carrier is configured as a wall with a U-shaped cross-section that is open to one side of the pre-cutter.

2. The pump according to claim 1, wherein each of the counter-blades forms a rupture edge that extends in parallel to the axis of the shaft portion.

3. The pump according to claim 1, wherein the counter-blades are adapted to be exchanged individually.

4. The pump according to claim 1, wherein the counter-blades are configured as reversible plates.

5. The pump according to claim 1, wherein positions of the counter-blades on the blade carrier are adjustable in at least one of:

an axial direction, and a radial direction.

6. The pump according to claim 1, wherein each wing has a free end with an outwardly angled catch that obstructs movement of chippings that slide along a convexly curved edge of the wing.

7. The pump according to claim 1, wherein each wing of the pre-cutter has a wear resistant coating at a leading edge thereof.

8. The pump according to claim 7, wherein the wear resistant coating is a welded layer.

9. A pump comprising:

a cutting wheel for cutting chippings that are contained in a medium pumped by the pump, a pre-cutter for cutting chippings that are contained in the medium pumped by the pump, the pre-cutter including a plurality of wings, a shaft portion which drives the pre-cutter and the shaft portion projects axially from the cutting wheel, and a crest of anvil blocks surrounding the pre-cutter such that free ends of the wings move past the anvil block with a little distance therebetween when the pre-cutter rotates, and the anvil blocks are configured as counter-blades that are held exchangeably at a blade carrier that surrounds the pre-cutter at least on a part of a periphery thereof, wherein the blade carrier includes slot-shaped openings and the counter-blades are inserted into the slot-shaped openings of the blade carrier.

10. The pump according to claim 9, wherein the openings are delimited by embossments of the blade carrier that form an engagement surface at which the counter-blade is adapted to be fixed with bolts.

* * * * *